United States Patent [19]

Ecker et al.

[11] 4,321,815

[45] Mar. 30, 1982

[54] APPARATUS FOR INTERCHANGEABLE MOUNTING OF ROLLERS, PARTICULARLY IN A STRAIGHTENING MACHINE

[75] Inventors: Karl-Heinz Ecker; Karl-Heinz Wahl, both of Erkelenz, Fed. Rep. of Germany

[73] Assignee: Wirth Maschinen-und Bohrgerate-Fabrik GmbH, Erkelenz, Fed. Rep. of Germany

[21] Appl. No.: 84,388

[22] Filed: Oct. 12, 1979

[30] Foreign Application Priority Data

Oct. 19, 1978 [DE] Fed. Rep. of Germany ..... 2845506

[51] Int. Cl.[3] ..... B21D 3/02; B21B 31/12

[52] U.S. Cl. ..... 72/160; 72/239

[58] Field of Search ..... 72/239, 238, 163, 160

[56] References Cited

U.S. PATENT DOCUMENTS

| | | | |
|---|---|---|---|
| 661,470 | 11/1900 | Fawell et al. | 72/239 |
| 1,935,091 | 11/1933 | Iversen | 72/239 |
| 3,558,871 | 1/1971 | Hlofcsak | 72/239 |
| 3,589,161 | 6/1971 | Moffett | 72/238 |
| 3,869,898 | 3/1975 | Quehen | 72/239 |

*Primary Examiner*—Ervin M. Combs

*Attorney, Agent, or Firm*—Holman & Stern

[57] ABSTRACT

Apparatus for interchangeable mounting of rollers, comprising a roller unit having a shaft or axis with at least one roller arranged thereon and having two end members, a frame with a holder into which the roller unit is insertable from above, and lifter elements provided in or on the frame and by means of which the roller unit is displaceable between an operative position in which it is supported in the frame by supporting bearer members and a raised interchanged position in which it is removable from the frame.

21 Claims, 8 Drawing Figures

APPARATUS FOR INTERCHANGEABLE MOUNTING OF ROLLERS, PARTICULARLY IN A STRAIGHTENING MACHINE

BACKGROUND OF THE INVENTION

This invention relates to apparatus for interchangeable mounting of rollers, particularly in a straightening machine for the continuous treatment of material, in particular rod material or profiled material to be straightened.

The rollers of such apparatus may serve for conveying material; in particular they are designed for affecting the material, more particularly for performing a straightening operation or a corrective bending process. The rollers may have a smooth periphery or a particular profile, or form such. The rollers must be interchangeable, not only because they are subjected to wear, but also in order to permit a roller with a given profile to be interchanged with one having a different profile.

A stable mounting is required for such rollers, in order that the loads occurring may be absorbed reliably. On the other hand, the interchange process should also involve as little expenditure and time as possible, in order that the standstill time of the respective machine, for example a straightening machine, is kept as short as possible, such standstills being caused by the roller interchange.

It is an object of the present invention to overcome such disadvantages and defects and to provide apparatus which receives the rollers securely for the operation, permits the interchanging process to be performed in a favourable manner and is suitable for multiple usage.

SUMMARY OF THE INVENTION

The present invention provides apparatus for interchangeable mounting of rollers, comprising a roller unit having a shaft or axis with at least one roller arranged thereon and having two end members, a frame with a holder into which the roller unit is insertable from above, and lifter elements provided in or on the frame and by means of which the roller unit is displaceable between an operative position in which it is supported in the frame by supporting bearer members and a raised interchange position in which it is removable from the frame.

The apparatus according to the invention is characterized inter alia in that the shaft carrying the roller is supported at two ends, so that even very large loads may be safely received, while nevertheless an easy interchange of the roller is performable with a relatively small expenditure and time requirement. This was hardly possible heretofore in a satisfactory manner.

The displacement path of the lifter elements is preferably such that the end members of the roller unit are clear of the frame in the interchange position. The lifter elements by means of which the roller unit may be lifted from the operative position to the interchange position may be suitably formed by adjuster elements, in particular screw-threaded spindles, which serve for positioning the roller unit at the operative height and the upper ends or which have the supporting bearer members attached thereto. The bearer members and the end members of the roller unit are preferably provided with centering devices designed for mutual engagement. Thereby the roller unit which has been placed thereon, for example by means of a lifting mechanism, is at the same time correctly positioned.

The lifter elements for the roller unit may alternatively be formed by two bearers which may be displaced between a lowered position and a raised effective position and into engagement with the undersides of the end members of the roller unit. In this case the undersides of the end members of the roller unit may be advantageously provided with centering recesses for receiving the upper ends of the bearers.

The bearers may be arranged parallel to or in particular concentric to adjuster elements, for example screw-threaded spindles, which serve for positioning the roller unit at the operative height. This leads to a space-saving, compact and stable construction.

For the purpose of moving the bearers, a mechanical drive or even a hydraulic drive utilizing a suitable pressure medium may be provided. In each case the bearers are advantageously retainable in their effective position. This may be suitably attained by a mechanical detent or by the closure of a pressure medium chamber.

The bearers may be suitably formed by piston rods of pistons which are displaceable in hydraulic cylinders. In this case the hydraulic cylinders are preferably located in adjuster elements, for example screw-threaded spindles, for positioning the roller unit at the operative height.

The apparatus according to the invention may be constructed in the form of a stationary roller block or the like, or if required even in the form of a roller block which is displaceable on a guide. In this case such a roller block may more particularly be arranged at the inlet end and/or the outlet end of a straightening machine or a similar adjusting machine.

Furthermore the apparatus according to the invention may form an essential portion of a roller straightening machine. In particular the apparatus may be provided in a multiple arrangement with mutual spacing such that the respective rollers of the roller units form at least partly the lower straightening rollers of the roller straightening machine. Accordingly, the invention thus also provides a roller straightening machine in which at least a portion of the straightening rollers are in the form of roller units mounted on two sides and displaceable by lifter elements from an operative position to a raised interchange position in which the roller unit is easily removable. When in this context a frame is referred to, the frame may be a component part of the roller straightening machine.

The apparatus of the invention may form a stationary portion of the roller straightening machine or alternatively a portion of the roller straightening machine which is displaceable in the travelling direction of material through the roller straightening machine. In the latter case, such a unit may be guided on a lower frame element, for example a base support or the like, of the roller straightening machine.

In every construction, be it as a separate roller block, as a part of an adjusting machine or in particular as a part of a roller straightening machine, there may be arranged underneath the roller or rollers a collecting and/or discharging device for scale or the like. Thereby a further serious problem which prevails in roller straightening machines and similar adjusting machines may be overcome in a favourable manner.

BRIEF DESCRIPTION OF THE DRAWINGS

The invention will be further described, by way of example only, with reference to the accompanying drawings, in which.

DETAILED DESCRIPTION OF THE INVENTION

Figure 2:
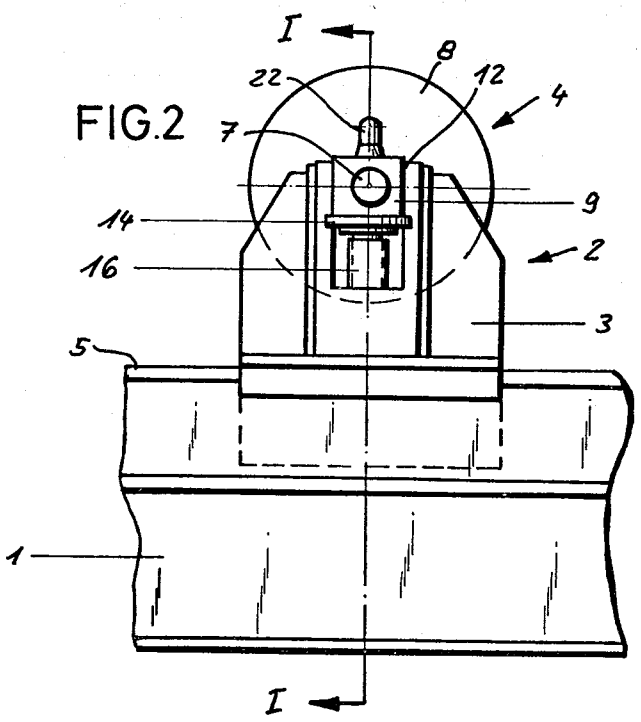
FIG. 2 is a front view of the apparatus shown in FIG. 1.
Figure 1:
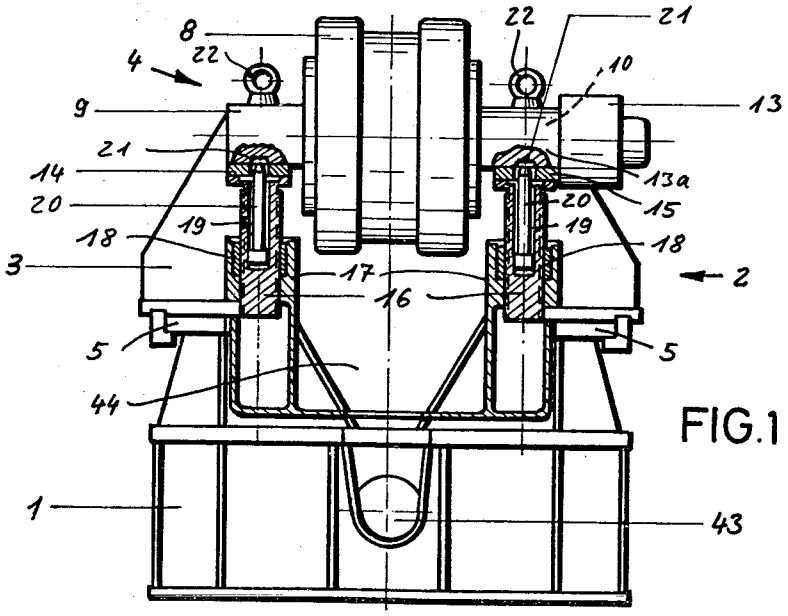
FIG. 1 is a side view of one embodiment of an apparatus according to the invention considered in the travelling direction of the material to be treated, being partly in section taken along the line I—I in FIG. 2.
Figure 4:
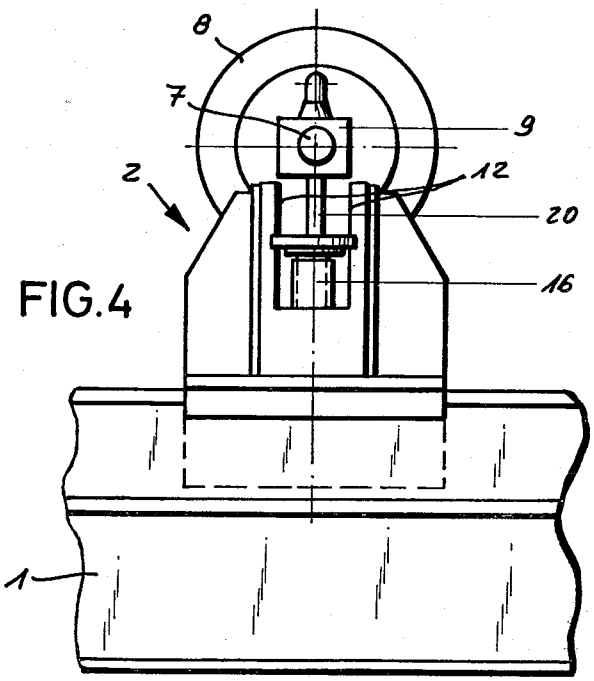
FIGS. 3 and 4 are views corresponding to FIGS. 1 and 2 respectively of the apparatus in the interchange position.
Figure 3:
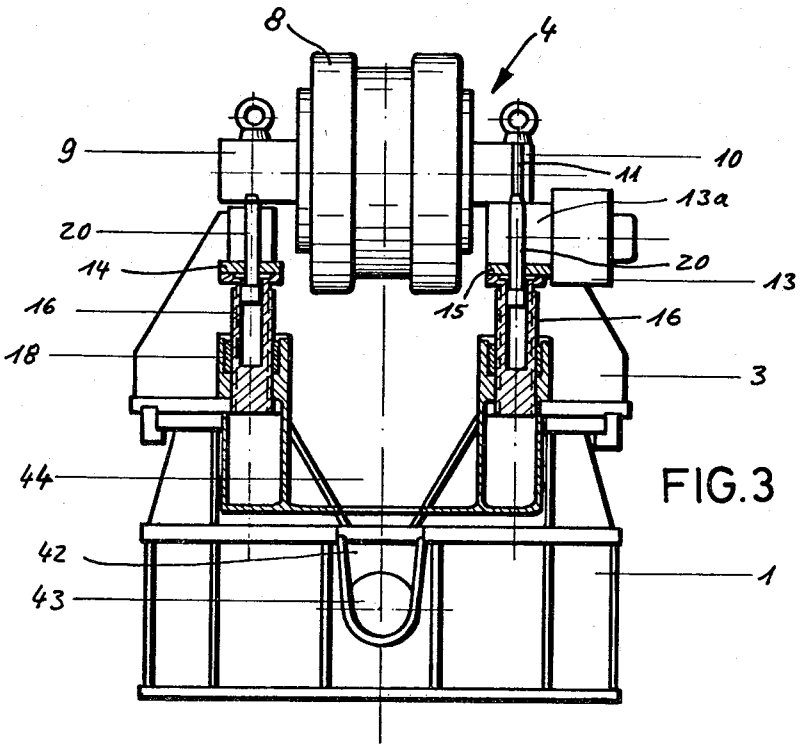

In the embodiment shown in FIGS. 1 to 4, a block-like unit 2 is arranged on a bed or like support 1 and comprises an approximately U-shaped frame 3 having two oppositely isposed jaws and which is arranged for receiving a roller unit 4. Depending upon the respective use, the frame 3 may be securely connected to its support or may itself form a support, or it may be displaceable on guides 5 of the support 1. In particular the support 1 may constitute the lower portion of a roller straightening machine.

The roller unit 4 comprises a carrier shaft or axis 7 with at least one roller 8 which is interchangeably fixed thereon, or which in a modified embodiment is alternatively rotatably mounted thereon; the roller 8 may have a smooth peripheral surface or, as illustrated, is profiled or consists of a plurality of parts assembled together for the purpose of forming a profile. An end member 9 forming a holder or a bearing for one end of the shaft 7 is insertable into an upwardly open two-sided guide 12 in the forward jaw of the frame 3 and is displaceable therein in a vertical direction. A further end member 10 of the roller unit 4 has on its sides vertically extending ledge-like projections 11 and engages in side members 13*a* of a casing 13; the side members 13*a* are provided with corresponding grooves for slidingly receiving the projections 11, whereby an axial mounting is obtained for the end member 10. Advantageously the casing 13 has elements for axial adjustment of the shaft 7 carrying the roller 8 relatively to the frame 3, or a body serving for this purpose, so that it may also be referred to as an axial adjustment casing. The side members 13*a* of the casing 13 may slide in guides (not illustrated) which are located in the rear jaw (on the right in FIGS. 1 and 3) of the frame 3 and may correspond for example to the guides 12 in the forward jaw which may be seen in FIGS. 2 and 4.

The end members 9 and 10 rest on plate-shaped bearers 14 and 15 respectively which may likewise slide in the guides 12 and which are fixed to the upper ends of two screw-threaded spindles 16. The casing 13 is held by the rear bearer 15. The screw-threaded spindles 16 form adjuster elements, in order to permit the roller unit 4 to be moved to the respective height correct for the operation. The screw-threaded spindles are guided in casings 17 in a non-rotatable but axially displaceable manner and are in engagement with nuts 18 which are axially supported and which can be rotated by means of driver elements (not illustrated).

Both screw-threaded spindles 16 form hydraulic cylinders 19 in which pistons having piston rods 20 are displaceable coaxially with the longitudinal axes of the screw-threaded spindles 16. The elements for supplying the pressure medium, for example hydraulic oil, to the cylinders 19 and for loading the pistons therein may be of conventional construction and are not specifically illustrated. The piston rods 20 form extendable bearer members which penetrate through openings in the bearings 14,15 and which can be moved into abutment with the undersides of the end members 9,10 of the roller unit 4. On their undersides, the end members 9,10 have conical recesses 21 into which can enter correspondingly conically constructed ends of the bearer members constituted by the piston rods 20. Thereby a safe support and at the same time satisfactory centering and alignment of the roller unit 4 relative to the guides 12 is obtained.

For the purpose of roller interchange, the screw-threaded spindles 16 are preferably moved to their highest position. By loading the piston rods 20 in the cylinders 19 with pressure medium, the piston rods 20 are then displaced upwardly and thereby raise the roller unit 4. Thereby the end member 9 is displaced from the guide 12 and the end member 10 from the recess between the side members 13*a* of the axial displacement casing 13 in an upward direction, so that the roller unit 4 is clear of the frame 3 and rests then only on the piston rods 20. In this position the entire roller unit 4 can be easily removed, e.g. by means of a crane, supporting elements being capable of engaging into eyelets 22 provided on the roller unit.

A different roller unit with a new roller, or even the previous roller unit with its roller interchanged, may then be brought up and placed upon the bearer members constituted by the piston rods 20. The piston rods 20 are then withdrawn by exhausting the pressure medium under the piston rods in the cylinders 19, until the end members 9 and 10 rest on the bearers 14 and 15 at the adjuster elements constituted by the spindles 16. The end members 9 and 10 are guided in this case by the forward guide 12 and by the groove and projection connection at the rear side.

Figure 6:
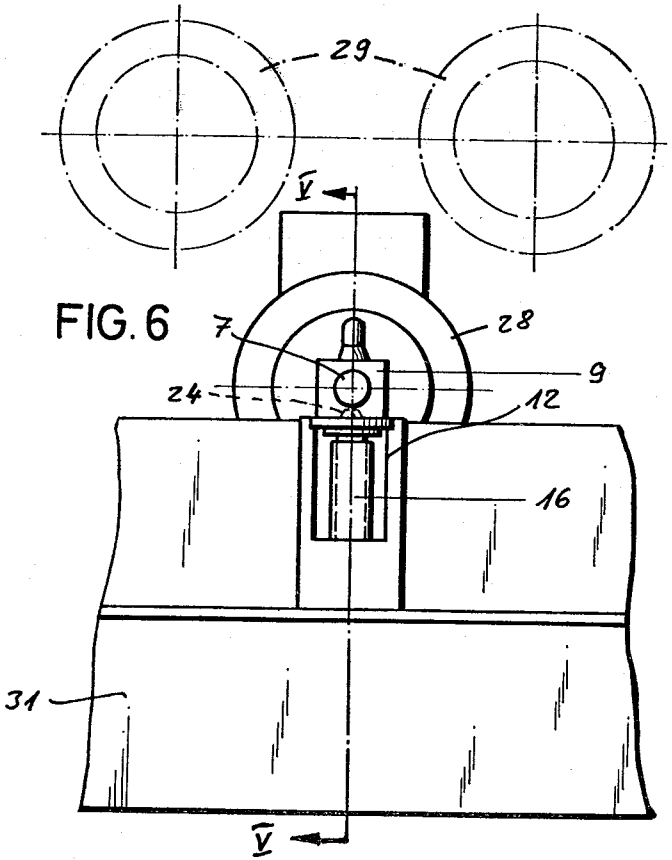
FIG. 6 is a front view of the apparatus shown in FIG. 5.
Figure 5:
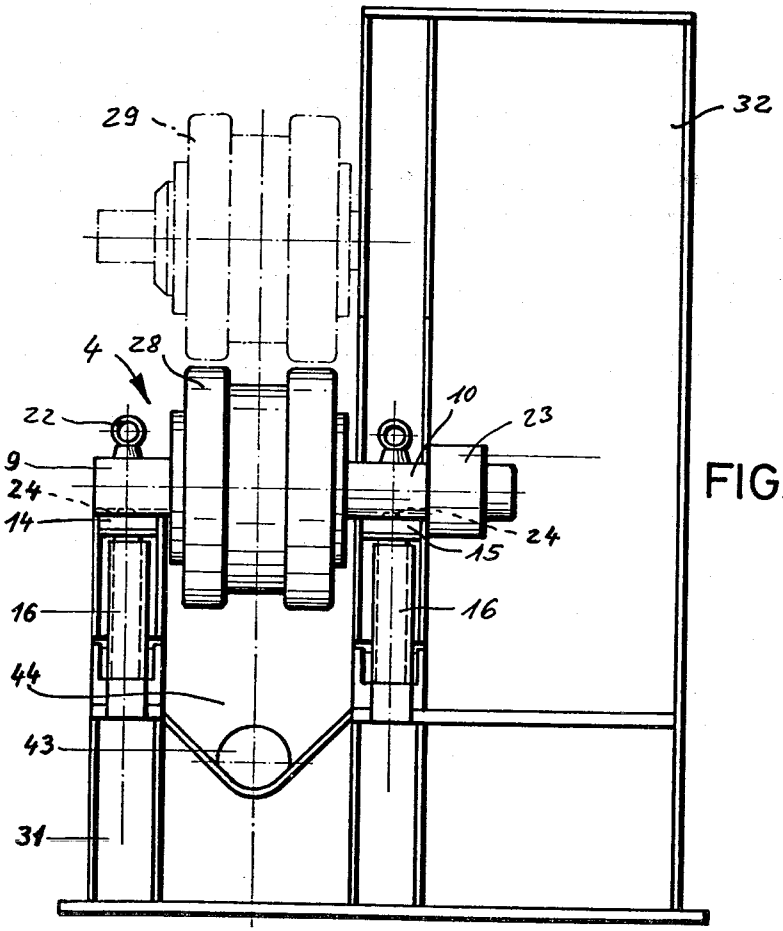
FIG. 5 is a side view of another embodiment of an apparatus according to the invention, considered in the travelling direction of the material, being partly in section taken along the line V—V in FIG. 6.

In the embodiment shown in FIGS. 5 and 6, support members as in the embodiment shown in FIGS. 1 to 4 are not present, but in this case the displacement path of the screw-threaded spindles 16, which otherwise correspond to the screw-threaded spindles shown in FIGS. 1 to 4, is so selected that by means of these screw-threaded spindles 16 the bearers 14,15 can be displaced as far as the upper ends of forward and rearward guides 12, so that the end members 9,10 of the roller unit 4 are then likewise clear of a casing 31 and the removal of the roller unit may take place as in the embodiment shown in FIGS. 1 to 4. The positioning of a fresh roller unit occurs correspondingly, centering abutments 24 on the upper surfaces of the bearers 14,15 and matching recesses in the undersides of the end members 9,10 ensuring the centering and alignment, so that during the lowering process the end members may slide downwardly between the guides 12.

Moreover, in the embodiment shown in FIGS. 5 and 6, the end member 40 is rigidly connected to an axial adjustment casing 23, so that the latter is removed together therewith. Thus the end member 10 slides directly in corresponding guides.

Figure 7:
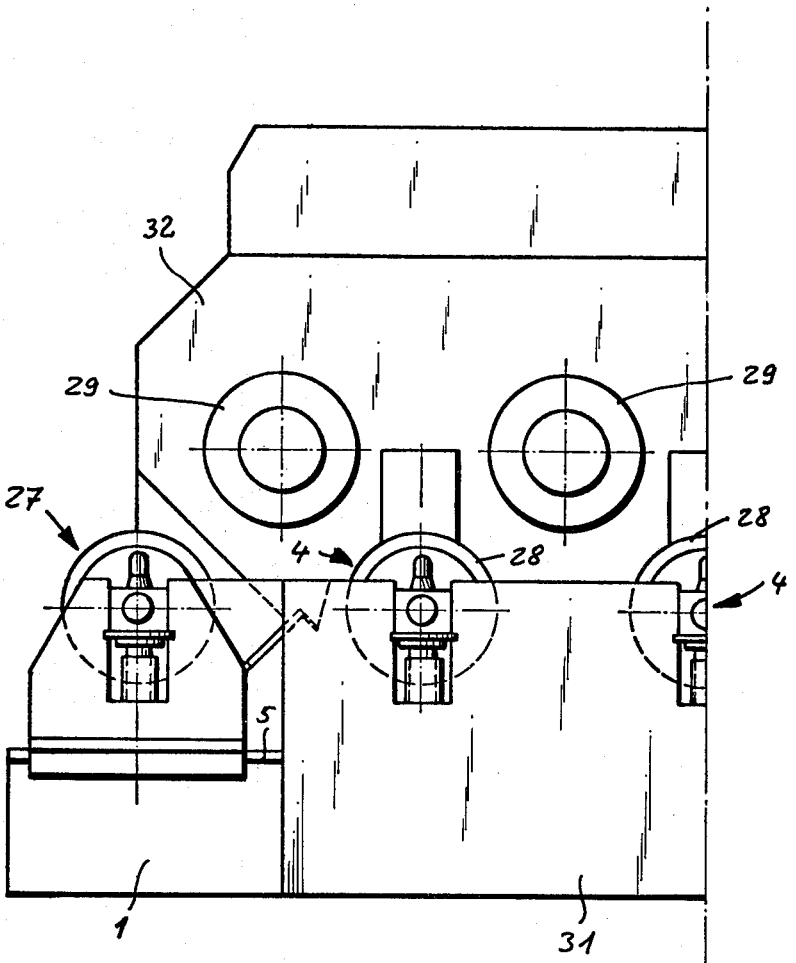
FIG. 7 is an elevational view of a portion of a roller straightening machine provided with apparatus constructed in accordance with the invention.

The embodiments described above may be embodied in roller blocks or similar units. Furthermore, however, they may be parts of an adjusting machine, in particular a roller straightening machine. Thus FIG. 7 illustrates a portion of a roller straightening machine with a stand 32 and a lower frame 31 connected thereto and with upper straightening rollers 29 and lower straightening rollers 28; the latter may be lifted out of the frame 31 as interchangeable roller units 4. The roller straightening machine can incorporate the apparatus shown in FIGS. 1 to 4 as well as that shown in FIGS. 5 and 6. For further clarification, the embodiment in the form of a straightening machine with a stand 32 and upper straightening rollers 29 is also indicated in FIGS. 5 and 6. In FIG. 7, an inlet block or outlet block respectively comprising an apparatus in accordance with the invention is indicated by reference numeral 27.

Figure 8:
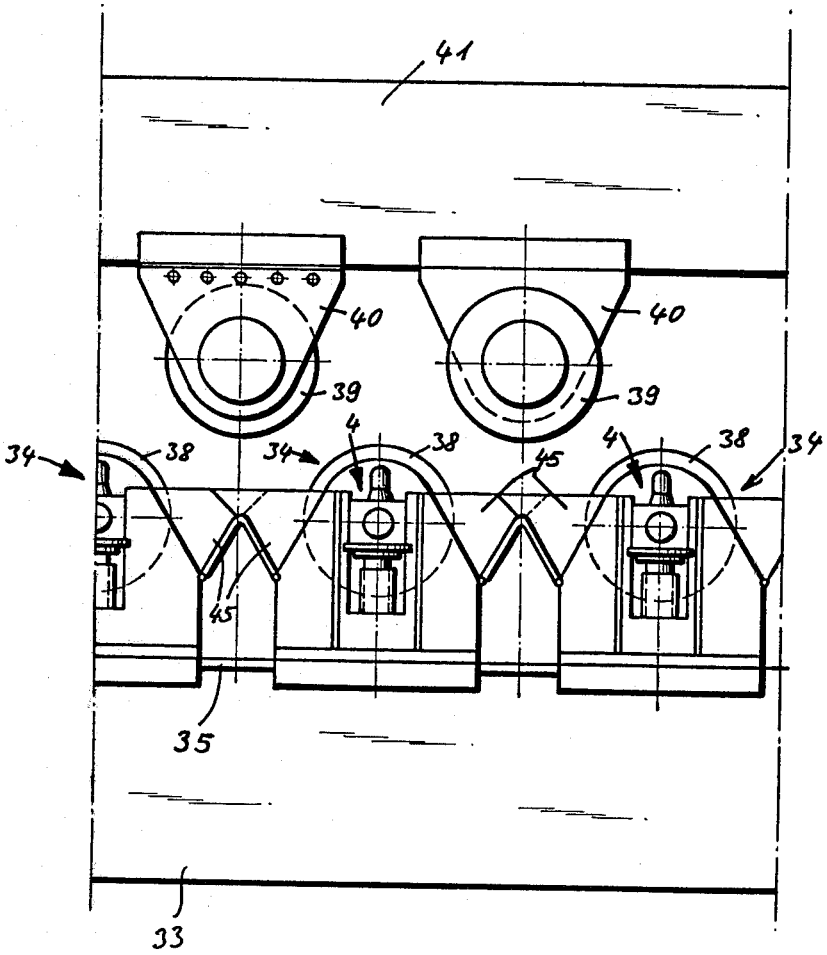
FIG. 8 is an elevational view of a portion of another embodiment of a roller straightening machine provided with apparatus constructed in accordance with the invention.

Whereas FIG. 7 illustrates a roller straightening machine with fixed roller division, FIG. 8 illustrates a roller straightening machine with variable roller division. Guides 35 are provided on a lower bottom support 33 and individual units 34 with lower straightening rollers 38 are arranged thereon in a mutually relatively displaceable manner. In this case also, the roller straightening machine can incorporate the apparatus shown in FIGS. 1 to 4, or that shown in FIGS. 5 and 6. The upper straightening rollers 39 are mounted in casings 40 which are adjustable at an upper longitudinal support 41 of the roller straightening machine.

As will be clear from the above, an advantageous double-sided bearing and mounting facility for straightening rollers or the like with simultaneously good interchangeability of the same may be attained. Moreover, a yet further important advantage is obtained by this kind of roller arrangement, which resides in the easier removal of accumulated scale which originates from the material being straightened or from material being treated in some other manner. As may be seen from FIGS. 1 and 3, a hopper 44 for scale or the like is located underneath the roller 8 and terminates in a channel 42 in the support 1. Alternatively a suitable conveyor 43 may be located in the latter.

If a roller straightening machine is involved, such a channel may lead through the entire machine stand, in order to carry away the scale, either by means of a worm, a conveyor belt, or by the effect of compressed air, water or any other suitable means.

In a machine with fixed roller division as shown in FIG. 7, the sides of the frame 31 may be constructed on the inside in the form of a hopper 44, and under certain circumstances may be provided with a conveyor 43 (see also FIG. 5). In a machine with variable roller division as shown in FIG. 8, such a hopper is formed by appropriate walls at the respective units 34, which are connected to each other by movable intermediate members 45, so that a continuous discharge means is produced. The intermediate members 45 may be constructed in particular in a connection-like manner in order to be able to follow all adjustment movements of the individual units 34.

In an alternative construction from the embodiments described, a carriage is vertically displaceable in guides of the frame and in turn has appropriate bearers for the end members of the roller unit.

We claim:

1. Apparatus for the interchangable mounting of rollers, comprising:

at least one roller unit, each unit including a roller having opposing end members and an axis of rotation coincident therewith;

a frame for holding said roller unit including a base and opposing arms, each arm including upwardly directed means for snugly receiving said end members; and means disposed within said arms and acting upwardly against said end members, for moving said end members between a raised interchange position and a lowered operative position within said receiving means, said moving means contacting undersides of said end members and defining therewith means for aligning said roller unit with said receiving means when said end members are in the raised position so that when said end members are moved to the lowered position, they fit snugly within said receiving means.

2. The apparatus of claim 1 wherein said receiving means comprises surface means for supporting said end members in said lowered position, and said aligning means comprise means for centering said roller unit in said receiving means when said end members are lowered to the lowered position.

3. The apparatus of claim 1 wherein said aligning means further comprises complementarily configured surfaces on each end member and its respective receiving means, one of said configured surfaces includes an upstanding rib.

4. The apparatus of claim 1 wherein said moving means comprises vertically extensible elongated members having maximum extent when said end members are in their raised position, and said aligning means comprise surface means on said end members complementarily configured with surface means on said elongated members.

5. The apparatus of claim 1 wherein when said moving means are translatable between raised and lowered positions, said end members of said roller unit being disposed above said frame when said moving means is in the raised position.

6. The apparatus of claim 4 wherein said elongated members comprise complementarily configured means for adjusting the vertical extent of said elongated members, said moving means further comprising bearing means translatable with said moving means in said receiving means against which said roller end member lies.

7. The apparatus of claim 1 including a plurality of said roller units and wherein said plurality of units comprise a roller straightening machine.

8. Apparatus according to claim 7, wherein said plurality of roller units comprise spaced upper and lower units which define a path for the roller straightening machine.

9. Apparatus according to claim 7, wherein at least one of said plurality of roller units is mounted in a stationary position on the roller straightening machine.

10. Apparatus according to claim 7, wherein at least one of said plurality of roller units is displaceably mounted on the roller straightening machine.

11. Apparatus according to claim 10, wherein said roller straightening machine further comprises a lower frame guide means upon which said one roller unit is displaceably mounted.

12. Apparatus according to claim 1, further comprising a scale collecting and discharging means located underneath the roller units.

13. Apparatus according to claim 1, wherein the moving means comprises two bearers which are movable between said lowered position and said raised position while maintaining engagement with the undersides of the end members of the roller unit.

14. Apparatus according to claim 13, wherein the undersides of the end members of the roller unit are provided with centering recesses for receiving the upper ends of the bearers.

15. Apparatus according to claim 13, wherein the bearers are arranged parallel to adjuster elements for positioning the roller unit at said lowered operative position.

16. Apparatus according to claim 13, wherein the bearers are arranged concentric to adjuster elements for positioning the roller unit at said lowered operative position.

17. Apparatus according to claim 13, further comprising mechanical means for vertically adjusting the bearers in said lowered operative position.

18. Apparatus according to claim 13, further comprising a hydraulic drive for the bearers.

19. Apparatus according to claim 13, further comprising means for retaining the bearers in said raised position.

20. Apparatus according to claim 19, wherein the bearers comprises piston rods of pistons which are displaceable in hydraulic cylinders.

21. Apparatus according to claim 20, wherein the hydraulic cylinders are arranged in adjuster elements for positioning the roller unit at said lowered operative position.

* * * * *